US008199176B2

(12) United States Patent
Kidnie et al.

(10) Patent No.: US 8,199,176 B2
(45) Date of Patent: Jun. 12, 2012

(54) LASER THERMAL DONOR ELEMENTS AND METHOD OF USE

(75) Inventors: Kevin M. Kidnie, St. Paul, MN (US); Pao Vang, Brooklyn Park, MN (US)

(73) Assignee: Eastman Kodak Company, Rochester, NY (US)

( * ) Notice: Subject to any disclaimer, the term of this patent is extended or adjusted under 35 U.S.C. 154(b) by 165 days.

(21) Appl. No.: 12/786,465

(22) Filed: May 25, 2010

(65) Prior Publication Data

US 2011/0292155 A1 Dec. 1, 2011

(51) Int. Cl.
*B41J 33/14* (2006.01)

(52) U.S. Cl. ..... 347/217

(58) Field of Classification Search ..... 347/217, 347/215, 221, 171–176; 400/120.01–120.04, 400/237, 241
See application file for complete search history.

(56) References Cited

U.S. PATENT DOCUMENTS

| | | | |
|---|---|---|---|
| 5,126,760 | A | 6/1992 | DeBoer |
| 5,171,650 | A | 12/1992 | Ellis et al. |
| 5,278,023 | A | 1/1994 | Bills et al. |
| 5,578,824 | A | 11/1996 | Koguchi et al. |
| 6,165,671 | A | 12/2000 | Weidner et al. |
| 6,190,827 | B1 | 2/2001 | Weidner |
| 6,270,934 | B1 | 8/2001 | Chang et al. |

FOREIGN PATENT DOCUMENTS

| | | |
|---|---|---|
| EP | 1 548 857 | 6/2005 |

*Primary Examiner* — Kristal Feggins
(74) *Attorney, Agent, or Firm* — J. Lanny Tucker

(57) ABSTRACT

Thermal transfer donor elements can be used to transfer color images to receiving elements to provide various elements such as color filters. The thermal transfer donor elements include a transparent polymeric substrate and, in order: a propellant layer comprising a gas-producing polymer that is capable of producing a gas upon heating by a thermal layer, and an infrared radiation absorbing compound, a barrier layer, and a thermal dye transfer layer one or more thermally transferable colorants. The barrier layer comprises a hydrophilic material and is transferred with the colorant to provide a transparent overcoat in the final color image. Color transfer can be achieved using laser thermal imaging.

16 Claims, No Drawings

LASER THERMAL DONOR ELEMENTS AND METHOD OF USE

FIELD OF THE INVENTION

This invention relates to laser thermal donor elements that can be used to thermally transfer a color image to receiving elements, for example to prepare color filter arrays. This invention also relates to a method of laser transfer of color images in receiving elements.

BACKGROUND OF THE INVENTION

Thermal transfer technology has been used for several decades to provide images, including color images, in receiving elements using infrared (thermal) laser devices. In general, most of these technologies rely on the conversion of infrared radiation to heat energy using an infrared radiation absorbing compound, and the subsequent transfer of one or more colorants from the exposed areas of a donor element to a receiving element. The images obtained in this manner can be monochrome or by a planned repetition of the process with various colorants in donor elements, a multi-colored image can be produced on a common receiving element. Such multicolor images can be used, for example, for generating color proofs or color filter arrays.

The basic thermal transfer technology is described for example in U.S. Pat. No. 5,126,760 (DeBoer) in which an IR absorbing compound is used to effect sublimation or diffusion of a colorant from a thermal transfer donor element to a receiving element.

U.S. Pat. No. 5,278,023 (Bills et al.) describes thermal transfer donor element containing a propellant layer to transfer colorants to receiving elements. In addition, U.S. Pat. No. 5,171,650 (Ellis et al.) describes a laser thermal donor element that is used to transfer a colorant to a receiving element using ablation imaging.

Other image forming thermal transfer donor elements are described in U.S. Pat. Nos. 5,578,824 (Koguchi et al.), 6,165,671 (Weidner et al.), 6,190,827 (Weidner), and 6,270,934 (Chang et al.). In particular, the Weidner patents describe thermal transfer donor elements having a hydrophilic layer, propellant layer, and colorant layer, arranged in that order on a substrate. The propellant layer usually includes an infrared radiation absorbing compound. They also describe the use of these donor elements to provide color images on receiving elements.

In known embodiments of thermal transfer donor elements, some of the infrared radiation absorbing compound transfer along with the colorants, thereby contaminating the color image on the receiving element and causing poor image quality. There is a need to provide improved thermal transfer donor element that provide improved transferred color images.

SUMMARY OF THE INVENTION

The present invention provides a thermal transfer donor element comprising a transparent polymeric substrate and having thereon, in order:

a propellant layer comprising a gas-producing polymer that is capable of producing a gas upon heating by a thermal layer, and an infrared radiation absorbing compound, a barrier layer, and a thermal dye transfer layer one or more thermally transferable colorants, wherein the barrier layer comprises a hydrophilic material.

This invention also provides a method for transferring a color image comprising:

imagewise thermally transferring a color image from the thermal transfer donor element of this invention to a receiving element to provide a color image in the receiving element.

The present invention provides thermal transfer donor elements that provide improved transferred color images without significant color contamination. The advantages of this invention are provided by putting the propellant layer adjacent the substrate and by arranging a thin barrier layer between the propellant layer and the thermal dye transfer layer (also known herein as the "colorant layer") that provides the transferred color image. When the propellant layer is disrupted during thermal imaging, the barrier layer and colorant layer in the image areas are transferred to a suitable receiver element that can be a simple transparent support. The transferred barrier layer provides a transparent overcoat to the transferred colorant image. Thus, no separate thermoplastic layer must be applied to the transferred color image. This arrangement and imaging process prevent unwanted transfer of infrared radiation absorbing compounds to the receiving element.

DETAILED DESCRIPTION OF THE INVENTION

The thermal transfer donor elements of this invention have a transparent polymeric substrate upon which the required layers are disposed. Such substrates are dimensionally stable and can withstand the heat of lasers used for thermal image transfer. Such substrates can be composed of polyesters such as poly(ethylene terephthalate) and poly(ethylene naphthalate), polyamides, polycarbonates, cellulose esters such as cellulose acetate, fluorine polymers such as poly(vinylidene fluoride) or poly(tetrafluoroethylene-co-hexafluoropropylene), polyethers such as polyoxymethylene, polyacetals, polyolefins such as polystyrene, polyethylene, polypropylene, and methylpentene polymers, and polyimides such as polyimide-amides and polyethylimides. The substrate generally has a dry thickness of from about 5 to about 200 μm and it can be coated with a subbing layer as described for example in U.S. Pat. No. 4,695,288 (Decharme). The substrate can also be coated with an antistatic or slip layer as is well known in the art.

The propellant layer used in this invention includes one or more gas-producing polymers that produce a gas upon heating by thermal means such as a laser. Useful gas-producing polymers include but are not limited to nitrocellulose, thermally decomposable polycarbonates as described for example in U.S. Pat. No. 5,156,938 (Foley et al.), and low ceiling temperature polymers as described for example in U.S. Pat. No. 5,576,144 (Pearce et al.). Useful gas-producing polymers also include vinyl polymers having recurring units of the following Structure (I):

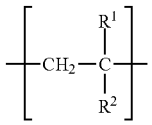

(I)

wherein $R^1$ and $R^2$ independently represents a ketal group, an acetal group, a thioketal group, a thioacetal group, or an unsaturated group containing a double or triple bond between any two atoms, one which is attached to the polymer backbone. Such unsaturated groups include but are not limited to, cyano, carbonyl, isocyanate, azide, sulfonyl, nitro, phosphoric, phosphonyl, aceylenic, ethylenic, substituted or unsubstituted carbocyclic aryl or heteroaryl groups. Alternatively, $R^1$ and $R^2$ can be joined together to form a ring. Particularly useful recurring units include those where at least one of $R^1$ and $R^2$ is cyano, and the polymers are poly(cyanoacrylates) that can be homopolymers or copolymers derived from both cyanoacrylates and other monomers that do not contain cyano groups. Useful poly(cyanoacrylates) include but are not limited to, poly(methyl cyanoacrylate), poly(ethyl-2-cyanoacrylate), poly(propyl-2-cyanoacrylate), poly(n-butyl-2-cyanoacrylate), poly(ethylhexyl-2-cyanoacrylate), and poly (methoxy cyanoacrylate).

The polymers used in the propellant layer can have an Mw of from 1000 to 1,000,000 as determined by size exclusion chromatography. The amount of the gas-producing polymer in the propellant layer is at least 75 and can be up to and including 98 weight %, based on the total propellant layer dry weight.

While the poly(cyanoacrylates) can include recurring units derived from monomer that are not defined by the structure (I) shown above, at least 50 mole % of the total recurring units are those defined by Structure (I). The other recurring units can be derived from (meth)acrylates, (meth)acrylamides, vinyl ethers, vinyl alkyl esters, maleic anhydride, maleimides, itaconic acid esters, fumaric acid and esters, and others that would be readily apparent to a skilled worker.

The propellant layer also includes one or more infrared radiation absorbing compounds that can be pigments or dyes and can be dispersed in suitable solvents including water and organic solvents. Useful infrared radiation absorbing compounds are described for example in U.S. Pat. No. 6,190,827 (noted above). Useful infrared absorbing dyes include cyanine dyes. The infrared radiation absorbing compounds can be present in an amount of about 2 to about 25 weight %, based on the total dry weight of the propellant layer.

The propellant layer can also include addenda such as coating aids, anti-oxidants, color neutralizing dyes, and UV stabilizers in amounts that are known in the art.

The propellant layer has a dry thickness of from about 0.05 to about 25 μm, or more likely from about 0.1 to about 10 μm. With modest experimentation, a skilled worker can determine the optimum propellant layer dry thickness to achieve the best transfer of thermally transferable colorants.

The propellant layer can be applied to the substrate using any suitable technique, but generally, it is applied as a coating techniques using suitable coating solvents, or printing techniques. Examples of coating solvents include but are not limited to, acetone, cyclopentanone, or other ketones, and mixtures thereof. The Invention Examples below show examples of how a propellant layer can be formulated and applied.

Adjacent the propellant layer is an applied barrier layer that comprises a hydrophilic material such as one or more of gelatin, a cellulose polymer, a poly(vinyl alcohol), poly(vinyl acetate), poly(vinyl pyrrolidone), sulfonated poly(styrene), and poly(meth)acrylamide, and any other hydrophilic materials that would be apparent to one skilled in the art. The hydrophilic material is particularly a poly(vinyl alcohol), a cellulose polymer, or both a poly(vinyl alcohol) and a cellulose polymer. The amount of the hydrophilic material in the barrier layer is generally at least and up to and including 100 weight % of the total barrier layer dry weight.

The barrier layer has a dry thickness of from about 0.05 to about 50 μm, or typically from about 0.1 to about 10 μm and can be applied to the propellant layer using any suitable technique such as a coating technique out of a suitable solvent such as water, or mixtures of water and water-miscible solvents such as alcohols. The barrier layer can optionally include a surfactant or other addenda that would not interfere with the transfer of the colorant layer to the receiving element. The Invention Examples provided below show how to formulate and coat a barrier layer. With modest experimentation, a skilled worker could find the optimum barrier layer thickness in relation to the propellant and thermal dye transfer layer to achieve desired imaging sensitivity and proper colorant transfer during imaging.

Lastly, a thermal dye transfer layer is disposed onto the barrier layer in a manner that is exemplified in the Invention Examples below. The thermal dye transfer layer includes one or more thermally transferable colorants in an amount of from about 5 to about 55 weight %, based on the total dry thermal dye transfer layer weight. Useful thermally transferable colorants are well known and can be used to provide any desired color such as white, black, red, yellow, blue, cyan, magenta, purple, or green. Mixtures of colorants can also be used. Examples of useful colorants include but are not limited to, organic pigments such as metal phthalocyanines (such as copper phthalocyanine), quinacridones, epindolidiones, Rubine F6B, Cromophthal® Yellow 3G, Hostasperm® Yellow 3G, Monastral® Violet R, 2,9-dimethylquinacridone, and others described in Col. 6, lines 54-61 of U.S. Pat. No. 6,165,671 (noted above) and references cited therein, all incorporated herein by reference, as well as inorganic pigments such as titanium dioxide, zinc oxide, barium sulfate, graphite, carbon black, iron oxide, chromium dioxide, cadmium sulfide, and chromates of lead, zinc, barium, and calcium. Other thermally transferable colorants include metal particles such as aluminum, copper, iron, nickel, and titanium particles.

Other useful thermally transferable colorants include organic dyes such as those described in Col. 7, lines 1-22 of U.S. Pat. No. 6,165,671 and references cited therein.

The thermally transferable colorants are dispersed in one or more organic solvent soluble binders including but not limited to, oligomers and polymers such as polyesters (for example, Tone P260®), polyacrylates, polymethacrylates, poly(alpha-methylstyrenes), poly(ethylene oxides), poly(vinyl acetals), poly(ethylene-co-vinyl chloride), polycarbonates, poly(vinyl butyral)s, cellulose acetate propionate, cellulose acetate butyrate, and other cellulosic esters.

The thermal dye transfer layer can also include optional addenda such as dispersing agents, surfactants, stabilizers, plasticizers, and coating aids in amounts that are known in the art.

The thermal dye transfer layer can be applied to the barrier layer using any suitable coating or printing technique as would be well appreciated by one skilled in the art. The dry thickness of the thermal dye transfer layer is generally from about 0.05 to about 10 μm or typically from about 0.1 to about 5 μm. With modest experimentation, a skilled worker would be able to determine the optimum thermal dye transfer layer thickness needed for image sensitivity and proper colorant transfer.

In some embodiments of this invention, the propellant layer comprises a cyanine infrared radiation absorbing dye dispersed in a poly(cyanoacrylate), the barrier layer comprises either a poly(vinyl alcohol) or methyl cellulose, and the thermal dye transfer layer comprises one or more pigments dispersed in an organic solvent soluble binder.

A color image is provided by transferring one or more of the thermally transferable colorants to a receiving element that generally includes a support that can also have thereon an image-receiving layer. However, the receiving element can be simply the support without any image-receiving layer. The support can be a transparent film composed of a poly(ether sulfone), polyimide, cellulose ester such as cellulose acetate, a poly(vinyl alcohol-co-acetal), polyester such as poly(ethylene terephthalate) or poly(ethylene naphthalate). The support can be a reflective material such as a baryta-coated paper or a synthetic paper, a pigmented polyester, ceramics, colored glass, or metal sheet. In most embodiments, however, the support of the receiving element is transparent so a color filter can be formed using the present invention.

If an image-receiving layer is present in the receiving element, this layer can be composed of a polycarbonate, polyurethane, polyester, poly(vinyl chloride), poly(styrene-co-acrylonitrile), polycaprolactone, or a poly(vinyl acetal) such as poly(vinyl butyral).

The process of providing a color image (such as in a color filter array) on the receiving element using the thermal transfer donor element of this invention is generally described in U.S. Pat. No. 5,126,760 (DeBoer) and is conveniently obtained on commercially-available laser thermal proofing systems such as the Kodak Approval® system or the Kodak® Trendsetter Spectrum system. Generally, a thermal transfer donor element is placed into intimate contact with a receiving element under suitable imaging conditions, such as pressure or vacuum. For example, the thermal transfer donor element is placed on a rotating drum followed by one or more successive placements of the individual cyan, magenta, yellow, and black thermal transfer donor elements whereby the image for each color is transferred by imagewise exposure of a laser beam through the backside of the thermal transfer donor element.

For example, the imagewise thermally transfer can be carried out using an infrared radiation laser, such as a diode laser that offers substantial advantages and provide imaging radiation at a wavelength for which the infrared radiation absorbing compound is sensitive. Such lasers are well known and commercially available from a number of sources. The lasers can be arranged in various printers.

In some embodiments, the transferred color image is a dye image. In other embodiments, the transferred color image is a pigment image.

Thus, a multi-color image can be transferred to the receiving element by successive thermal transfer of multiple colors from multiple thermal transfer donor elements. The resulting color images can be used as color filters or color proofs that have utilities that are well known in the art.

The present invention provides at least the following embodiments and combinations thereof:

1. A thermal transfer donor element comprising a transparent polymeric substrate and having thereon, in order:

a propellant layer comprising a gas-producing polymer that is capable of producing a gas upon heating by a thermal layer, and an infrared radiation absorbing compound, a barrier layer, and a thermal dye transfer layer one or more thermally transferable colorants, wherein the barrier layer comprises a hydrophilic material.

2. The element of embodiment 1 wherein the barrier layer comprises one or more of gelatin, a cellulose polymer, a poly(vinyl alcohol), poly(vinyl acetate), poly(vinyl pyrrolidone), sulfonated poly(styrene), and poly(meth)acrylamide.

3. The element of embodiment 1 or 2 wherein the barrier layer comprises a poly(vinyl alcohol) or a cellulose polymer, or both a poly(vinyl alcohol) and a cellulose polymer.

4. The element of any of embodiments 1 to 3 wherein the barrier layer has a dry thickness of from about 0.05 to about 50 μm.

5. The element of any of embodiments 1 to 4 wherein the gas-producing polymer is nitrocellulose or a poly(cyanoacrylate).

6. The element of any of embodiments 1 to 5 wherein the propellant layer has a dry thickness of from about 0.05 to about 25 μm.

7. The element of any of embodiments 1 to 6 wherein the propellant layer comprise from about 2 to about 25 weight % of the infrared radiation absorbing compound.

8. The element of any of embodiments 1 to 7 wherein the propellant layer comprises an infrared radiation absorbing dye.

9. The element of any of embodiments 1 to 8 wherein the colorant layer includes one or more thermally transferable colorants in an amount of from about 5 to about 55 weight %, which thermally transferable colorants are dispersed in one or more organic solvent soluble binders.

10. The element of any of embodiments 1 to 9 wherein the propellant layer comprises a cyanine infrared radiation absorbing dye dispersed in a poly(cyanoacrylate), the barrier layer comprises either a poly(vinyl alcohol) or methyl cellulose, and the colorant layer comprises one or more pigments dispersed in an organic solvent soluble binder.

11. A method for transferring a color image comprising: imagewise thermally transferring a color image from the thermal transfer donor element of any of embodiments 1 to 10 to a receiving element to provide a color image in the receiving element.

12. The method of embodiment 11 wherein the imagewise thermally transferring is carried out using an infrared radiation laser.

13. The method of embodiment 11 or 12 wherein the transferred color image is a dye image.

14. The method of embodiment 11 or 12 wherein the transferred color image is a pigment image.

15. The method of any of embodiments 11 to 14 for providing a color filter array.

16. The method of any of embodiments 11 to 15 wherein a multi-color image is transferred to the receiving element by successive thermal transfer of multiple colors from multiple thermal transfer donor elements.

The following Examples are provided to illustrate the practice of the invention and its advantages, and the Examples are not intended to be limiting in any manner.

EXAMPLES

The following materials were used in the Examples:

Airvol® 205 is a poly(vinyl alcohol) (PVA) that can be obtained from Air Products and Chemicals.

Gantrez® S-97 is a methyl vinylether/maleic acid copolymer that can be obtained from International Specialty Products.

IR Dye 70712 is an infrared radiation absorbing dye that is identified as Dye 1 in Column 5 of U.S. Pat. No. 6,165,671 (noted above).

PCA represents poly(cyanoacrylate) that was prepared according to the teaching in U.S. Pat. No. 6,165,671 (Weidner et al.) that is incorporated herein by reference.

Silwet® L7001 is an organosilicone surfactant that can be obtained from Momentive Performance Materials.

Tergitol® TMN-10 is a branched secondary alcohol ethoxylate surfactant that can be obtained from Dow Chemical Corporation.

Byk® 310 is a surfactant that was obtained from Byk Chemie.

MY 2500 FSY, MY 2500 FYJ, MY 2500 EMC, MY 2500 GAF, SE-6GFL, Blue 67, 322E-D94, and Victoria Blue are colorants. Blue 67 and Victoria Blue are well known in the art and can be purchased from several sources including HW Sands (Jupiter, Fla.). The other colorants have the following structures with identifiers underneath the corresponding structures:

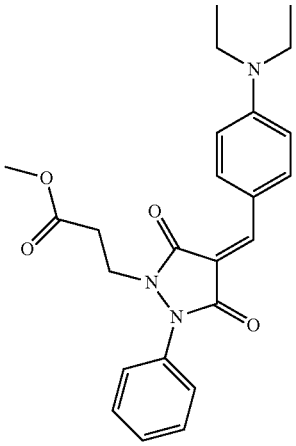

MY2500 FSY

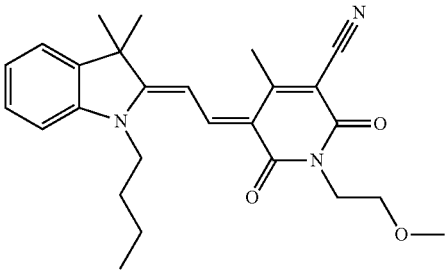

MY 2500 FYJ

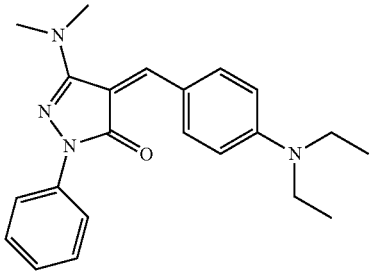

MY 2500 EMC

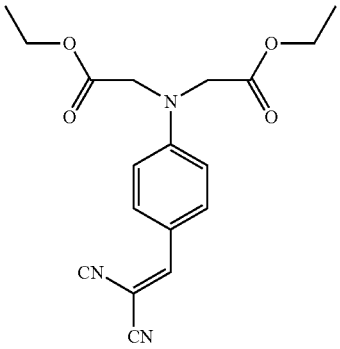

MY 2500 GAF

-continued

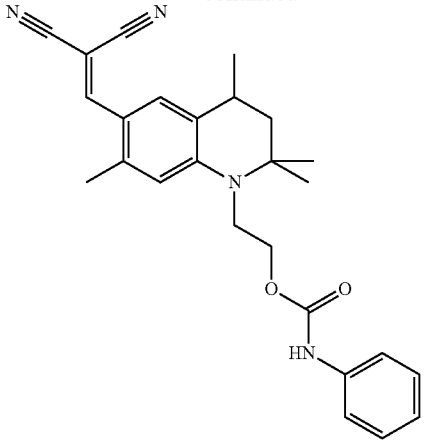

SE-6GFL

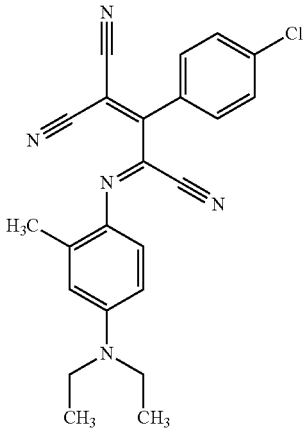

322E-D94

Elvacite® 2895 is a methyl methacrylate copolymer that can be obtained from Lucite International.

Elvacite® 2045 is a poly(isobutyl methacrylate) that can be obtained from Lucite International.

Tone 767P® is a poly(caprolactone) that was obtained from Dow Chemical Company.

Eastman CAP 482-0.5 is a cellulose acetate propionate that was obtained from Eastman Chemicals Company.

Sylojet® P-405 is a syloid (silicon dioxide) particulate gel that can be obtained from Grace Davison.

Comparative Example 1

The following components were coated onto a 100 μm poly(ethylene terephthalate) film out of a mixture of deionized water and n-propanol to provide a dry coated first layer coating weight of 100-130 mg/ft$^2$ (1.08-1.40 g/m$^2$) after oven drying for 2 minutes at 100° C.:

| Component | Percent Solids |
|---|---|
| Airvol ® 205 solution | 81.65 |
| Gantrez ® S-97 | 12.00 |
| IR dye 707012 | 5.50 |

Over the first layer, the following components were coated out of an acetone/cyclopentanone solvent blend to provide a dry coated second layer coating weight of 20-40 mg/ft$^2$ (216-432 mg/m$^2$) after oven drying for 2 minutes at 100° C.:

| Component | Percent Solids |
|---|---|
| PCA | 99.97 |
| Silwet ® L-7001 | 0.03 |

Over this second layer, a red colorant layer was coated out of organic solvents such as MEK, Dowanol® PM, and toluene to provide a dry coating weight of 85-100 mg/ft$^2$ (0.918-1.08 g/m$^2$) after oven drying for 2 minutes at 100° C., using the following components:

| Component | Percent Solids |
|---|---|
| MY 2500 FYJ colorant | 31.710 |
| MY 2500 FSY colorant | 1.810 |
| MY 2500 EMC colorant | 1.100 |
| Elvacite ® 2895 | 43.960 |
| Tone 767P ® polymer | 7.150 |
| Eastman CAP 482-0.5 | 14.200 |
| Sylojet ® P405 | 0.240 |
| Byk ® 310 | 0.01 |

Laser thermal imaging of the resulting thermal transfer donor element was accomplished using a Kodak® Trendsetter at the following settings: SD 60, DS 90 and Wpower 16W through the backside onto a receptor sheet (receiver element) consisting only of a poly(ethylene terephthalate) film (100 μm).

The resulting image quality of the transferred color image was poor (very non-uniform with a rough surface). In addition, the color appearance of the transferred image was poor.

We measured the color image and compared the color image to the hand spread color of the colorant layer only (best possible color). The results were as follows and the L*, a*, b*, C*, and ha*b* CIELAB color space were obtained using a common densitometer and known calculations as described for example by Billmeyer and Saltzman in *Principles of Color Technology, 2$^{nd}$* Ed., John Wiley & Sons, 1981 that is incorporated herein by reference. ΔE is defined as follows:

$$\Delta E=[(L_2^*-L_1^*)^2+(a_2^*-a_1^*)^2+(b_2^*-b_1^*)^2]^{1/2}$$

| | L* | a* | b* | c* | ha*b* | ΔE |
|---|---|---|---|---|---|---|
| Hand Spread | 64.14 | 72.58 | 37.42 | 81.66 | 27.27 | 0 |
| Red Color Image | 55.97 | 64.59 | 34.54 | 73.24 | 28.14 | 11.79 |

With such a large ΔE between the colorant layer color and the image color image, it is apparent the color quality of the transferred color image was quite poor for the Comparative Example 1 thermal transfer donor element.

Invention Example 1

A red color thermal transfer donor element of this invention was prepared by coating the following components onto on a sheet of poly(ethylene terephthalate) (100 μm) out of an acetone/cyclopentanone solvent blend to provide a propellant layer of 40-80 mg/ft$^2$ (432-864 mg/m$^2$) after oven drying at 2 minutes at 100° C.:

| | Percent Solids |
|---|---|
| PCA | 86.77 |
| IR Dye 707012 | 13.23 |

A barrier layer was then formed over the propellant layer by coating the following components out of deionized water and dried for 2 minutes at 100° C. to provide a dry coating weight of 10-15 mg/ft$^2$ (108-162 mg/m$^2$):

| | Percent Solids |
|---|---|
| PVA | 97.00 |
| Tergitol ® TMN 10 | 3.00 |

A colorant layer as described above for Comparative Example 1 was then formed over the propellant layer. The resulting thermal transfer donor element was then imaged the same way as Comparative Example 1. The resulting image quality was very smooth with uniform edges and the color appearance was very good.

The following colorimetric values were obtained from the Invention Example 1 donor element and compared to the use of a colorant layer coated alone on a poly(ethylene terephthalate) film support (Control):

| | L* | a* | b* | c* | ha*b* | ΔE |
|---|---|---|---|---|---|---|
| Control | 65.09 | 70.74 | 33.35 | 78.21 | 25.24 | |
| Invention Donor Element | 64.48 | 72.83 | 35.06 | 80.83 | 25.71 | 2.77 |

These data clearly show that a much truer color result was obtained using the thermal transfer donor element of the present invention.

Comparative Example 2

A thermal transfer donor element was prepared like Invention Example 1 but the barrier layer was omitted. Imaging was carried out as described for the previous examples. The resulting image quality was poor with a very non-uniform rough surface. In addition, the color appearance was poor.

Invention Example 2 and 3

Green (Invention Example 2) and Blue (Invention Example 3) thermal transfer donor elements of this invention were prepared in the same fashion as the red donor thermal transfer donor element of Invention Example 1 except the following components were used to prepare the colorant layers out of the solvents described above:

Invention Example 2 Green Colorant Layer

| | Percent Solids |
|---|---|
| MY 2500 GAF colorant | 24.33 |
| SE6-GFL colorant | 4.300 |
| Blue 67 colorant | 19.80 |

-continued

| | Percent Solids |
|---|---|
| Elvacite ® 2895 | 26.50 |
| Elvacite ® 2045 | 11.55 |
| Eastman CAP 482-0.5 | 14.5 |
| Sylojet ® P405 | 0.250 |
| Byk ® 310 | 0.01 |

Invention Example 3 Blue Colorant Layer

| | Percent Solids |
|---|---|
| Blue 67 colorant | 23.00 |
| 322E-D94 colorant | 8.600 |
| Victoria Blue colorant | 2.650 |
| Elvacite ® 2895 polymer | 43.52 |
| Tone 767P ® polymer | 8.080 |
| Eastman CAP 482-0.5 | 14.06 |
| Sylojet ® P405 | 0.240 |
| Byk ® 310 | 0.01 |

Samples of the Invention Red, Green, and Blue thermal transfer donor elements were imaged sequentially to provide individual RedGreenBlue tiles in a color filter array pattern on a receiving element. Imaging was completed with the same settings as described above for Invention Example 1, except that imaging using the green and blue donor elements was made onto the same receiving element having the red imaged pattern. The resulting color filter array formed with this process exhibited good edge quality and smooth-appearing tile surfaces.

The invention has been described in detail with particular reference to certain preferred embodiments thereof, but it will be understood that variations and modifications can be effected within the spirit and scope of the invention.

The invention claimed is:

1. A thermal transfer donor element comprising a transparent polymeric substrate and having thereon, in order:

a propellant layer comprising a gas-producing polymer that is capable of producing a gas upon heating by a thermal layer, and an infrared radiation absorbing compound, a barrier layer, and a thermal dye transfer layer one or more thermally transferable colorants, wherein the barrier layer comprises one or more of gelatin, a cellulose polymer, a poly(vinyl alcohol), polyvinyl acetate), poly(vinyl pyrrolidone), sulfonated poly(styrene), and poly(meth)acrylamides.

2. The element of claim 1 wherein the barrier layer comprises a poly(vinyl alcohol) or a cellulose polymer, or both a poly(vinyl alcohol) and a cellulose polymer.

3. The element of claim 1 wherein the barrier layer has a dry thickness of from about 0.05 to about 50 μm.

4. The element of claim 1 wherein the gas-producing polymer is nitrocellulose or a poly(cyanoacrylate).

5. The element of claim 1 wherein the propellant layer has a dry thickness of from about 0.05 to about 25 μm.

6. The element of claim 1 wherein the propellant layer comprise from about 2 to about 25 weight % of the infrared radiation absorbing compound.

7. The element of claim 1 wherein the propellant layer comprises an infrared radiation absorbing dye.

8. The element of claim 1 wherein the colorant layer includes one or more thermally transferable colorants in an amount of from about 5 to about 55 weight %, which thermally transferable colorants are dispersed in one or more organic solvent soluble binders.

9. The element of claim 1 wherein the propellant layer comprises a cyanine infrared radiation absorbing dye dispersed in a poly(cyanoacrylate), the barrier layer comprises either a poly(vinyl alcohol) or methyl cellulose, and the colorant layer comprises one or more pigments dispersed in an organic solvent soluble binder.

10. A method for transferring a color image comprising:

imagewise thermally transferring a color image from the thermal transfer donor element of claim 1 to a receiving element to provide a color image in the receiving element.

11. The method of claim 10 wherein the imagewise thermally transferring is carried out using an infrared radiation laser.

12. The method of claim 10 wherein the transferred color image is a dye image.

13. The method of claim 10 wherein the transferred color image is a pigment image.

14. The method of claim 10 wherein the thermal transfer donor element comprises a gas-propellant layer comprising a poly(cyanoacrylate).

15. The method of claim 10 for providing a color filter array.

16. The method of claim 10 wherein a multi-color image is transferred to the receiving element by successive thermal transfer of multiple colors from multiple thermal transfer donor elements.

* * * * *